US009451367B2

(12) United States Patent
Basseas et al.

(10) Patent No.: US 9,451,367 B2
(45) Date of Patent: Sep. 20, 2016

(54) ON-SITE, CUSTOM FITTED HEARING EQUALIZER

(75) Inventors: Stavros Basseas, Park Ridge, IL (US); Steven C. Hannibal, Buffalo Grove, IL (US)

(73) Assignee: CONVERSION SOUND INC., Park Ridge, IL (US)

( * ) Notice: Subject to any disclaimer, the term of this patent is extended or adjusted under 35 U.S.C. 154(b) by 1516 days.

(21) Appl. No.: 12/721,167

(22) Filed: Mar. 10, 2010

(65) Prior Publication Data

US 2010/0232612 A1 Sep. 16, 2010

Related U.S. Application Data

(60) Provisional application No. 61/159,287, filed on Mar. 11, 2009.

(51) Int. Cl.
*H04R 25/00* (2006.01)

(52) U.S. Cl.
CPC ..... *H04R 25/305* (2013.01); *H04R 25/552* (2013.01); *H04R 25/554* (2013.01); *H04R 25/70* (2013.01); *H04R 25/656* (2013.01); *H04R 25/658* (2013.01); *H04R 2225/021* (2013.01); *H04R 2225/023* (2013.01); *H04R 2225/31* (2013.01); *H04R 2225/51* (2013.01); *H04R 2225/55* (2013.01); *H04R 2225/63* (2013.01); *H04R 2460/01* (2013.01); *H04R 2460/05* (2013.01)

(58) Field of Classification Search
CPC ..... H04R 2225/021; H04R 2225/55; H04R 2225/63; H04R 25/70; H04R 25/305; H04R 25/552; H04R 25/554; H04R 25/656; H04R 25/658; H04R 2460/01; H04R 2460/05; H04R 2225/023; H04R 2225/31; H04R 2225/51
USPC ..... 381/60, 366; 181/130, 135
See application file for complete search history.

(56) References Cited

U.S. PATENT DOCUMENTS

| | | | | |
|---|---|---|---|---|
| 3,921,756 A | | 11/1975 | Johnson | |
| 5,303,306 A | | 4/1994 | Brillhart et al. | |
| 5,390,254 A | | 2/1995 | Adelman | |
| 5,721,783 A | * | 2/1998 | Anderson | H04B 1/385 381/312 |

(Continued)

FOREIGN PATENT DOCUMENTS

| | | |
|---|---|---|
| WO | WO 96/41498 | 12/1996 |
| WO | WO 2008/043793 A1 | 4/2008 |

OTHER PUBLICATIONS

Extended European Search Report, dated Aug. 6, 2012, corresponding to Application No. EP 10 75 1354.

(Continued)

*Primary Examiner* — Davetta W Goins
*Assistant Examiner* — Jasmine Pritchard
(74) *Attorney, Agent, or Firm* — Husch Blackwell LLP; George S. Pavlik

(57) ABSTRACT

A modular, cost effective customizable sound processing unit can provide enhanced audio from a displaced source to a user. The source can be wirelessly coupled to the unit via a short range transceiver. The processing unit can include circuitry and software to process incoming audio and to compensate for the loss of hearing due to the device been coupled to the user ear canal, making it acoustically transparent for sound sources picked by the on the unit microphone(s) and provide an enhanced audio experience for the user.

16 Claims, 13 Drawing Sheets

TWO DIFFERENT MODULAR CONFIGURATIONS OF AUDIO PROCESSING APPARATUS / ASSISTIVE LISTENING DEVICE

(56) References Cited

U.S. PATENT DOCUMENTS 7,720,245 B2 * 5/2010 Bauman ..... H04R 25/608 381/312
7,779,844 B2 * 8/2010 Purcell ..... A61F 11/10 128/864
8,027,638 B2 * 9/2011 Sanguino ..... H04R 25/554 381/312
8,175,310 B2 * 5/2012 Nielsen ..... H04R 25/608 381/322
8,311,252 B2 * 11/2012 Dittli ..... H04R 25/456 381/322
8,340,338 B2 * 12/2012 Mlodzikowski ..... H04R 1/1016 381/328
8,437,489 B2 * 5/2013 von Dombrowski .. H04R 25/48 381/328
2004/0010181 A1 * 1/2004 Feeley ..... H04R 25/608 600/25
2004/0258263 A1 * 12/2004 Saxton ..... H04R 25/652 381/328
2009/0245530 A1 * 10/2009 Keady ..... A61F 11/08 381/72

OTHER PUBLICATIONS

PCT International Preliminary Report on Patentability corresponding to International Application No. PCT/US2010/026826, dated Sep. 13, 2011.
PCT International Search Report corresponding to International Application No. PCT/US2010/026826, mailed May 4, 2010.
Written Opinion of the International Searching Authority corresponding to International Application No. PCT/US2010/026826, mailed May 4, 2010.

* cited by examiner

TWO DIFFERENT MODULAR CONFIGURATIONS OF AUDIO PROCESSING APPARATUS / ASSISTIVE LISTENING DEVICE

ADJUST AND LOCK TUBE FOR AUDIO PROCESSING APPARATUS / ASSISTIVE LISTENING DEVICE

DIFFERENT COUPLING METHODS TO THE USER EAR OF AUDIO PROCESSING APPARATUS / ASSISTIVE LISTENING DEVICE

AUDIO PROCESSING APPARATUS/ ASSISTIVE LISTENING DEVICE
PERSONAL EQUALIZER/ INSERTION LOSS COMPENSATOR IN NORMAL MODE OF OPERATION WITH THE OPTION OF PAIRING WITH CELL PHONES OR MP3 PLAYERS OR REMOTE MICROPHONE

AUDIO PROCESSING APPARATUS/ ASSISTIVE LISTENING DEVICE
IN FINE TUNING, HEARINGLOSS TESTING, AMPLIFICATION EMULATION MODE OF OPERATION
PAIRED WIRELESSLY WITH THE PDA OR CELL PHONE OR LAPTOP COMPUTER

EVALUATION - TESTING APPARATUS/ MEDALLION
IN HEARINGLOSS TESTING AND AMPLIFICATION EMULATION MODE OF OPERATION PAIRED
WIRELESSLY WITH THE PDA OR CELL PHONE OR LAPTOP COMPUTER

AUDIO PROCESSING AND EVALUATION-TESTING APPARATUSES IN REPAIR MODE MODE OF OPERATION PAIRED WIRELESSLY WITH THE PDA OR CELL PHONE OR LAPTOP COMPUTER

CONSTRUCTION OF CUSTOM EAR MOLD FOR AUDIO PROCESSING APPARATUS / ASSISTIVE LISTENING DEVICE

SEMI-CUSTOM EAR MOLD COUPLED TO THE USER EAR OF AUDIO PROCESSING APPARATUS / ASSISTIVE LISTENING DEVICE

BATTERY CHARGER FOR AUDIO PROCESSING APPARATUS / ASSISTIVE LISTENING DEVICE

ON-SITE, CUSTOM FITTED HEARING EQUALIZER

CROSS-REFERENCE TO RELATED APPLICATION

This application claims the benefit of the filing date of U.S. Provisional Application Ser. No. 61/159,287 filed Mar. 11, 2009 and entitled "On-Site—Custom Fitted Hearing Equalizer Optimized For Personal Hearing Needs and Preferences and for Insertion Loss Compensation". The '287 application is hereby incorporated herein by reference.

FIELD

The invention pertains to modular rechargeable Audio Processing Apparatuses—Assistive Listening devices which can be coupled wirelessly to personal digital assistants, computers or the like for use, initial adjustment and configuration. More particularly, the invention pertains to such devices implementable as customizable, wireless headsets.

BACKGROUND

Current Headsets provide wired or wireless connectivity with cellular phones or music players via non custom or semicustom ear canal adaptors that result in poor retention and inconsistent sound level and frequency response. More people wear headsets for longer periods of time and they tend to leave them on even when they are not in use (communicating with external devices, cell-phones, etc). Very few of those devices may have a pass-thru mode, where sounds are passed from the microphone to the speaker/receiver of the headset.

When the physical fit is tight, the headset acts as an earplug, if the pass-thru mode is not available, reducing contact of the user with the environment in addition to being uncomfortable both because of the pressure applied on the ear canal walls as well as the fullness of the occluded canal.

When the fit is loose, the device is not acting as an earplug to the surrounding sounds but it is still uncomfortable since it needs to be continuously readjusted and repositioned. More importantly, because sound enters the ear directly, the signal enhancing processing algorithms such as noise reduction, or directionality are heavily compromised. When the device is used in a pass thru mode, where sound from the microphone is passed to the speaker/receiver of the unit, higher levels of amplification/equalization are not possible due to the loose physical fit (large volume of air) and the echo/feedback cancellation processing is compromised.

The current headsets over-amplify the low frequencies to compensate for the loose fit but cannot adjust the low frequencies to match the variability of the fit. Miniature extended frequency response receivers/speakers suitable for the small volumes of the enclosed ear canal depend on a good tight fit to deliver extended frequency response for a true pass-thru mode especially for non hearing impaired users.

Further yet, the current headset devices do not provide for a way for equalization (other than over all volume) nor for hearing compensation procedures and tools. The receivers/speakers used in current headsets are not suitable for users with hearing impairment because they have extended lower frequencies in addition to over amplifying them and causing masking to upper frequencies where the impairment is usually manifested.

DETAILED DESCRIPTION

Figure 1A:
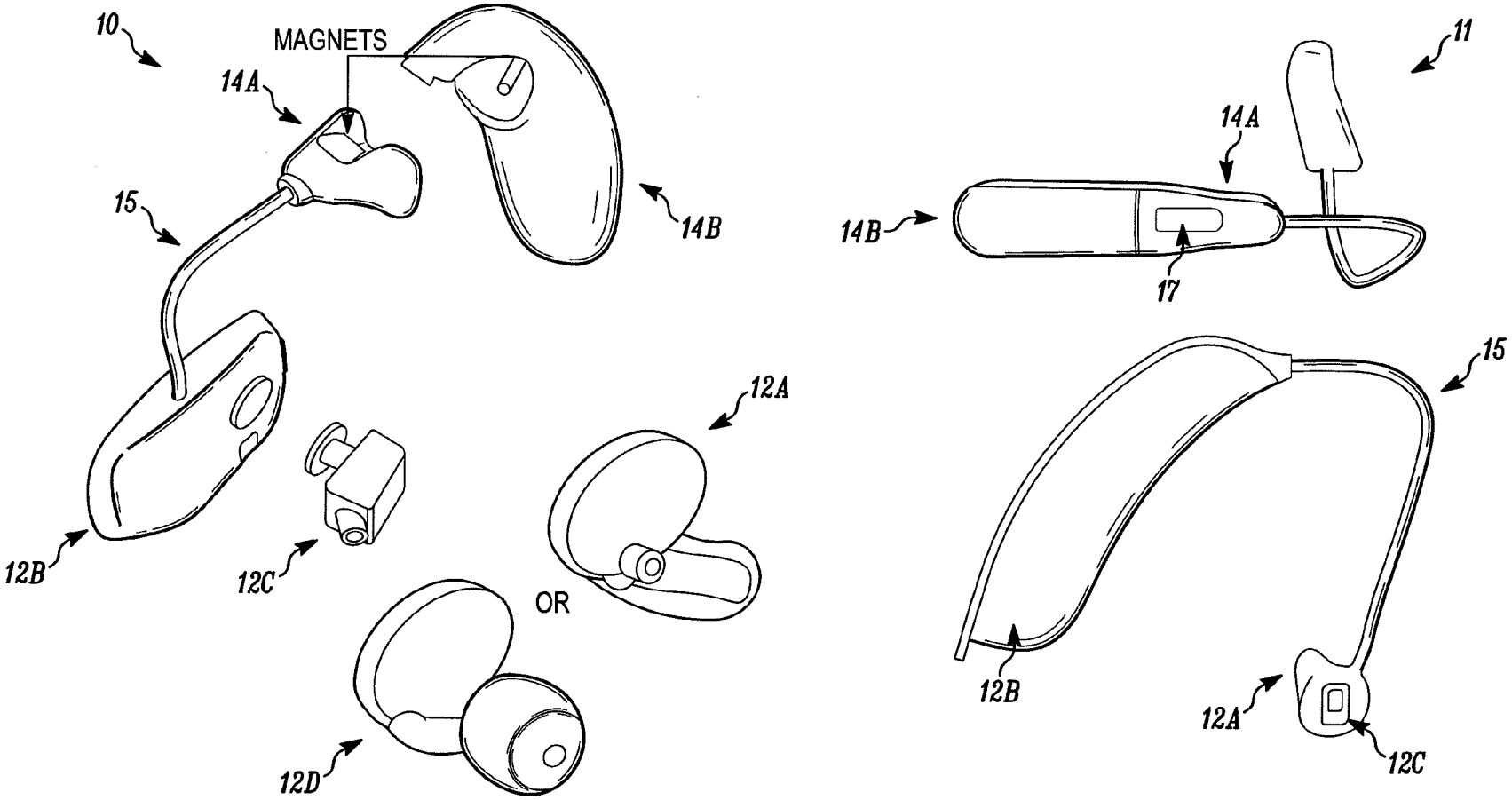
FIGS. 1A-1C are a sequence of images illustrating various aspects of two configurations of one embodiment—Normal Mode of operation s of the invention.

While embodiments of this invention can take many different forms, specific embodiments thereof are shown in the drawings and will be described herein in detail with the understanding that the present disclosure is to be considered as an exemplification of the principles of the invention, as well as the best mode of practicing same, and is not intended to limit the invention to the specific embodiment illustrated.

Embodiments of the invention can include, a custom fitted hearing device with good comfortable retention in the ear canal and sufficient attenuation which allow for the full utilization of the speech enhancing processing both while the device receives sounds from external devices or when it operates in a pass-thru/transparent mode.

Another aspect includes an instant, on the spot, process for creating a custom mold that can be easily administered by the user or with the help of a minimally trained helper in certain markets, as in the developing world.

A consistent, easy quick-to-administer detection of the equalization settings based on user needs. An interactive parameter adjustment procedure for fitting/programming the instrument. An optional wireless remote (PDA, cell phone or computer) that adds more flexibility in optimizing/customizing the device. These procedures can be self administered by the user or with the help of a minimally trained helper in certain markets.

A modular device, FIG. 1A (separate modules for electronics, battery, receiver, ear mold and such modules distributed over the ear, in front of the ear concha and in the ear canal with adjustable length interconnections) allows for easy on the spot adjustments, repair or servicing, and extends the use and the life of the product. A smart hearing aid detection and repair process implemented on the optional wireless remote (PDA, cell phone or computer). Modularity is very critical for the success of the device in underdeveloped markets.

A rechargeable battery and a charger that supports solar and user generated energy sources such as a hand cranked generator, as well as conventional power sources.

Figure 6A:
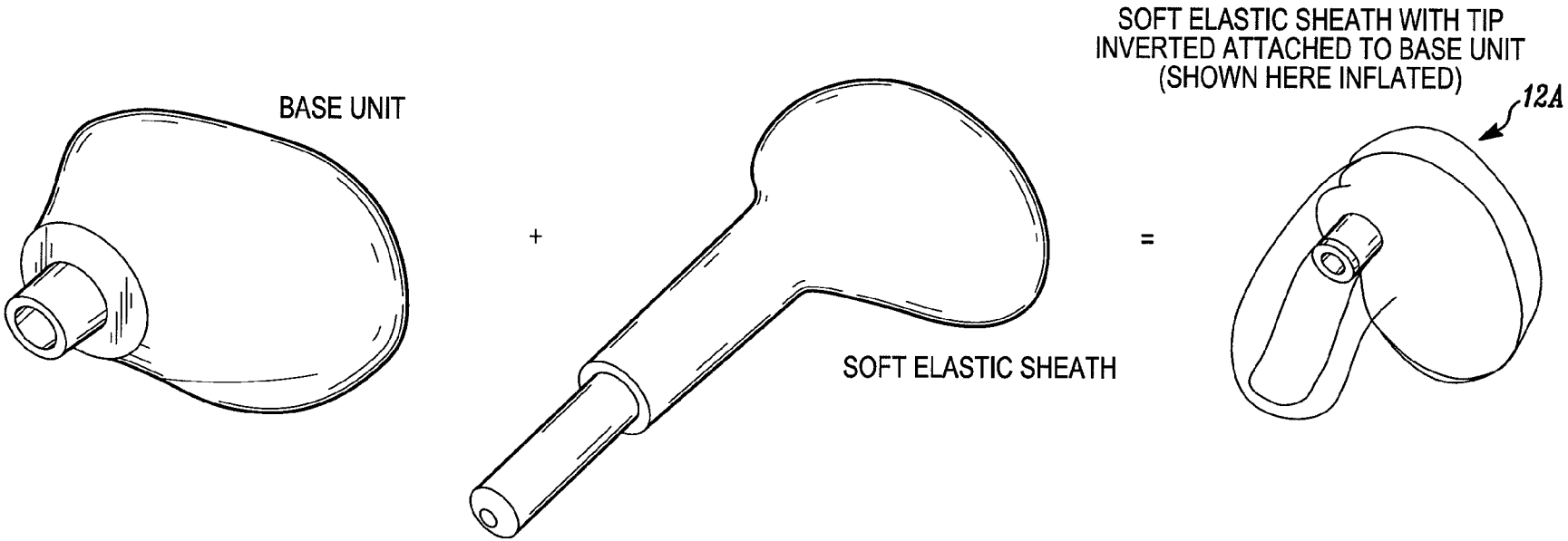
FIGS. 6A-6C illustrate aspects of a method in coupling to the ear with an aspect of the invention.
Figure 6B:
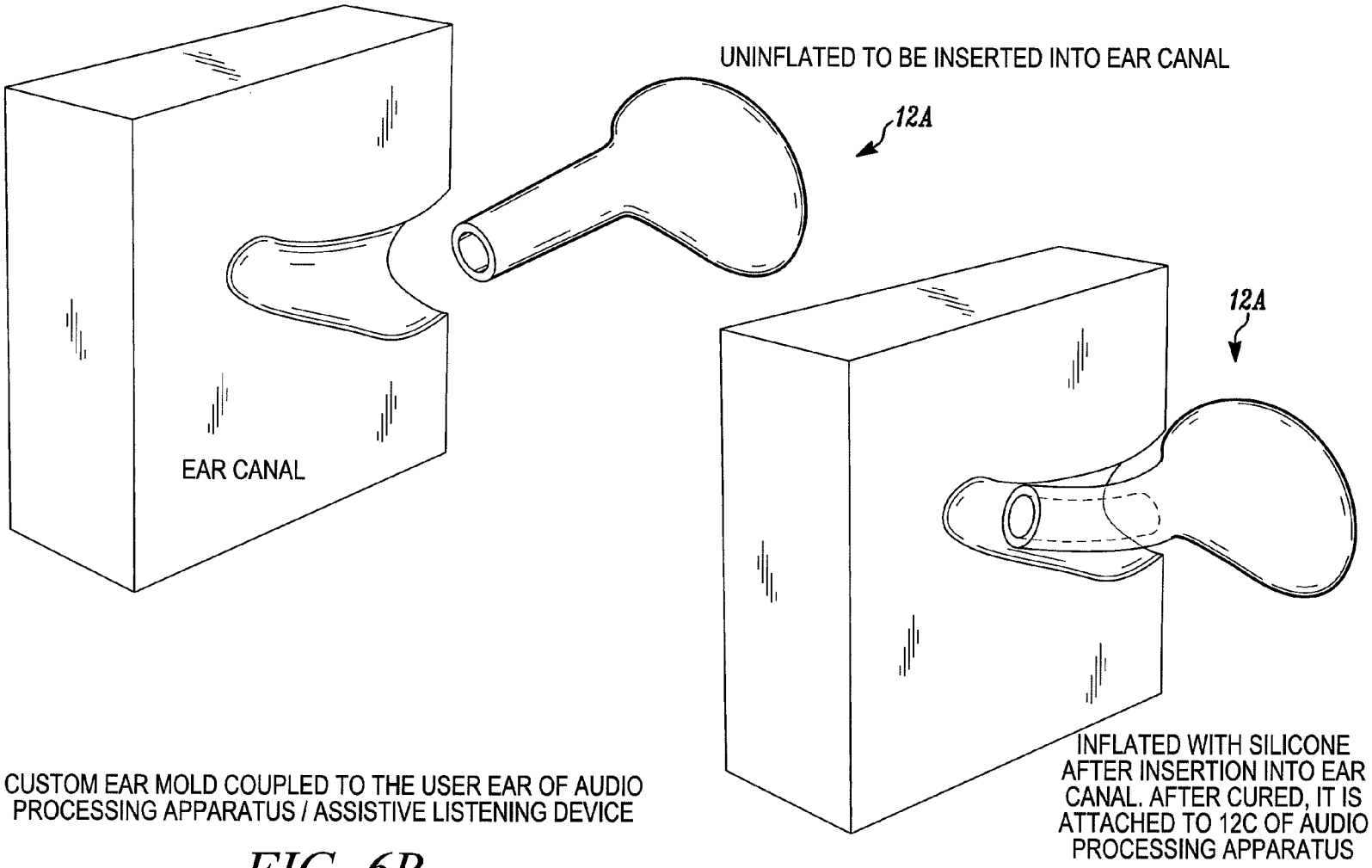
Figure 6C:
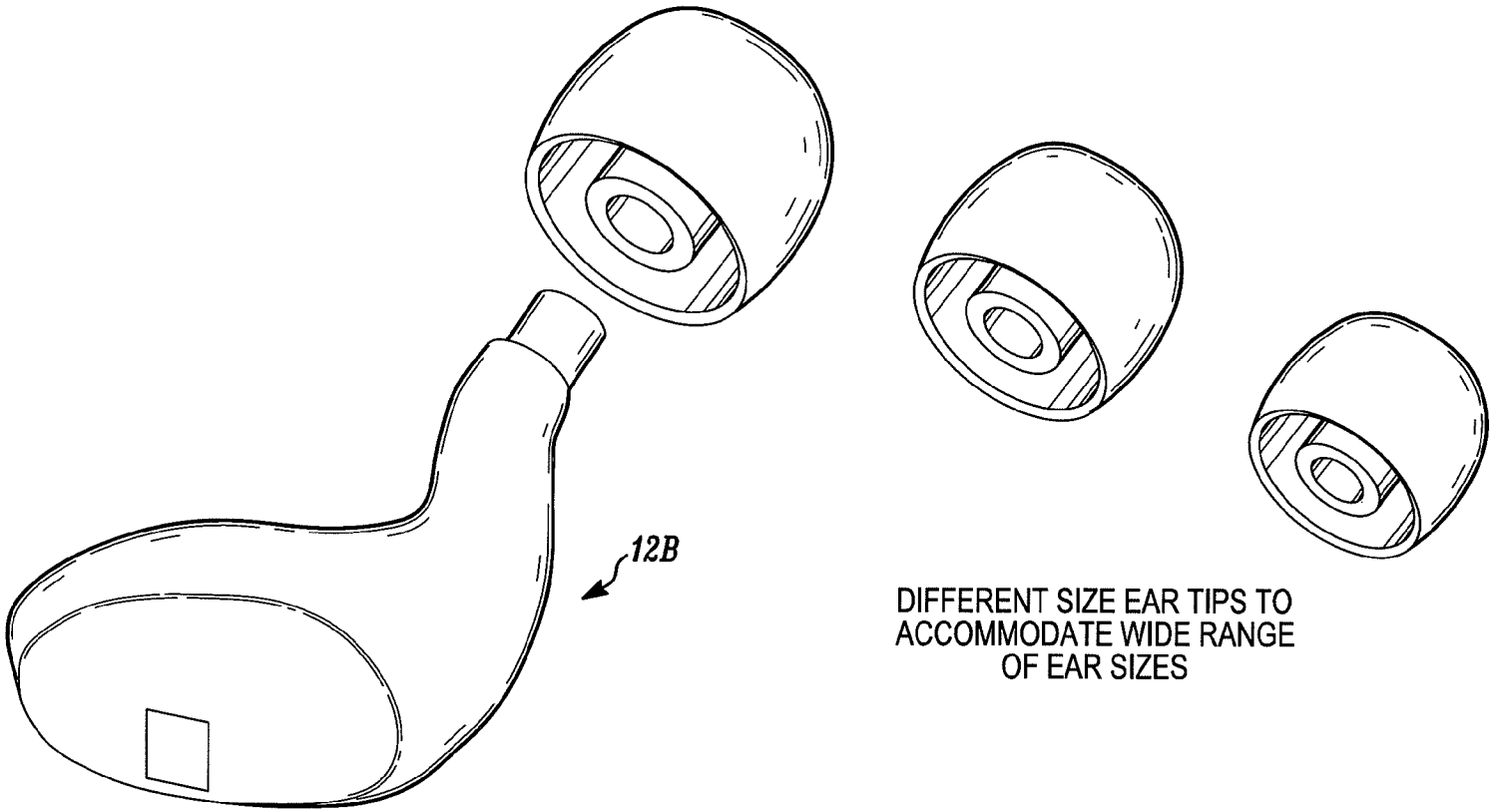

Other aspects of the invention can include:

A custom FIGS. 6A-6B or semi-custom FIG. 6C on the spot mold that allows for comfortable retention and provides sufficient attenuation from environmental sound distractions and allows the signal enhancing processing (noise reduction, directionality, equalization) to control the sound that gets into the ear either in communication or pass-thru mode of operation.

Consistent and predictable equalization and amplification because of the consistent placement due to the custom ear mold.

Reduced cognitive effort for the user by overcoming hearing difficulties (by equalization and signal enhancement) based on environmental or personal physical limitations.

Transparent/pass-thru mode (sound comes from microphone on the unit) that takes into consideration the attenuation introduced by having a mold covering the ear canal.

It wirelessly communicates and receives/transmits sounds to many devices such as cell phones or wireless adaptors for regular phones, mp3 players, TV audio wireless adaptors, computers etc.

Takes into consideration the listening environment and adjusts accordingly as to increase sound clarity and reduce cognitive effort by the user (normal or impaired hearing) in difficult environments.

Equalization of device is dependent on self hearing assessment (or with third party assistance) to correctly set the preferred equalization/amplification level.

Hearing and preference assessment is accomplished through generating sounds via an algorithm that determines hearing/preference level of the individual wearing the device. The wearer indicates when the sound is heard via responding to a signal from the sound generating device which could be the hearing device or other hand held device (mobile phone, PDA, his own personal computer, etc).

The hearing assessment program monitors the environmental sound level to determine if environment is suitable for assessment of the specific individual's hearing limitations.

The hearing device is capable of picking up signals from the microphone (environmental sounds) or external signals through an internal antenna (such as signals generated by remote devices such cell phone, MP3 player, computer, PDA).

The device can adjust it settings based on environment automatically or manually.

The device allows for user adjustment of its equalization parameters with the help of appropriate cue sounds.

The device automatically adjusts its default setting based on past adjustment history.

The hearing device contains algorithms that are activated based on input signal characteristics.

The hearing device can switch automatically between input signals.

The hearing devices can be used on both ears with individual assessment of both ears.

The hearing devices when worn binaurally can act independently of one another or in coordination with regard to input.

A modular device that allows for onsite repair. Parts can be snapped to and from the device. The optional remote (PDA, Cell phone, computer) generates diagnostic tests for each module and calls for the replacement/needed repair.

In yet another aspect of the invention, an off-the-self, relatively inexpensive personal digital assistant, (PDA), and included fuzzy logic-type, expert system, software can be used by individuals with very limited training to accurately measure hearing, compensate for noisy ambient environments during testing and detect underlying medical conditions for follow-up. The same PDA could be used to carry out fitting, fine tuning, or on-site repair of the respective hearing device.

In yet another aspect of the invention, user's can adjust the device to suit their particular requirements from casually listening to downloaded music to improving their reception of locally generated audio. Adjustments can be made directly via local controls on the device or via a programmed PDA which the user could carry.

Rechargeable batteries can be provided. A hand cranked generator can be used for recharging where no utility supplied energy is available.

In a further aspect of the invention, a very low cost, custom ear mold can be provided using a standard, preformed inflatable balloon. A balloon, which might include inserts such as a sound tube, or removable shapes, for example for coupling to an associated electronics package, can be inserted into the ear of a user. The balloon can be filled with silicone which when cured will correspond to the user's ear canal. The cured silicone shape can then be removed from the user's ear and attached to the electronics package.

In a further aspect of the invention, very low cost, selection of semicustom ear molds can be provided allowing for accommodation of a wide range of ear sizes both in terms of ear canal circumference and length.

Another embodiment of the invention can be used to carry out testing of various types to evaluate hearing loss. This alternate embodiment can also be used with a local, programmed PDA. Separate microphones and audio output devices, receivers, can be provided for each ear.

Figure 1B:
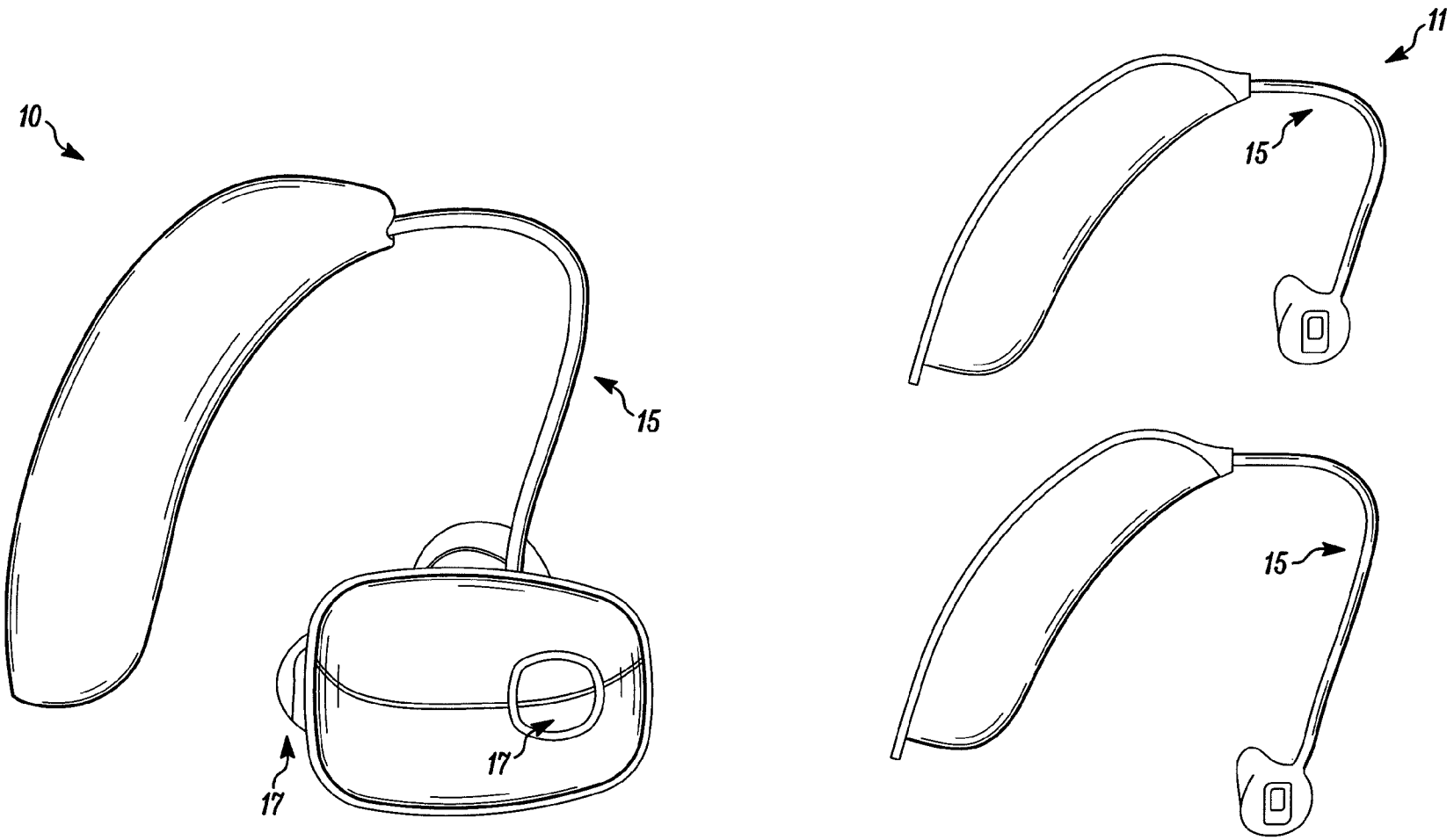
Figure 1C:
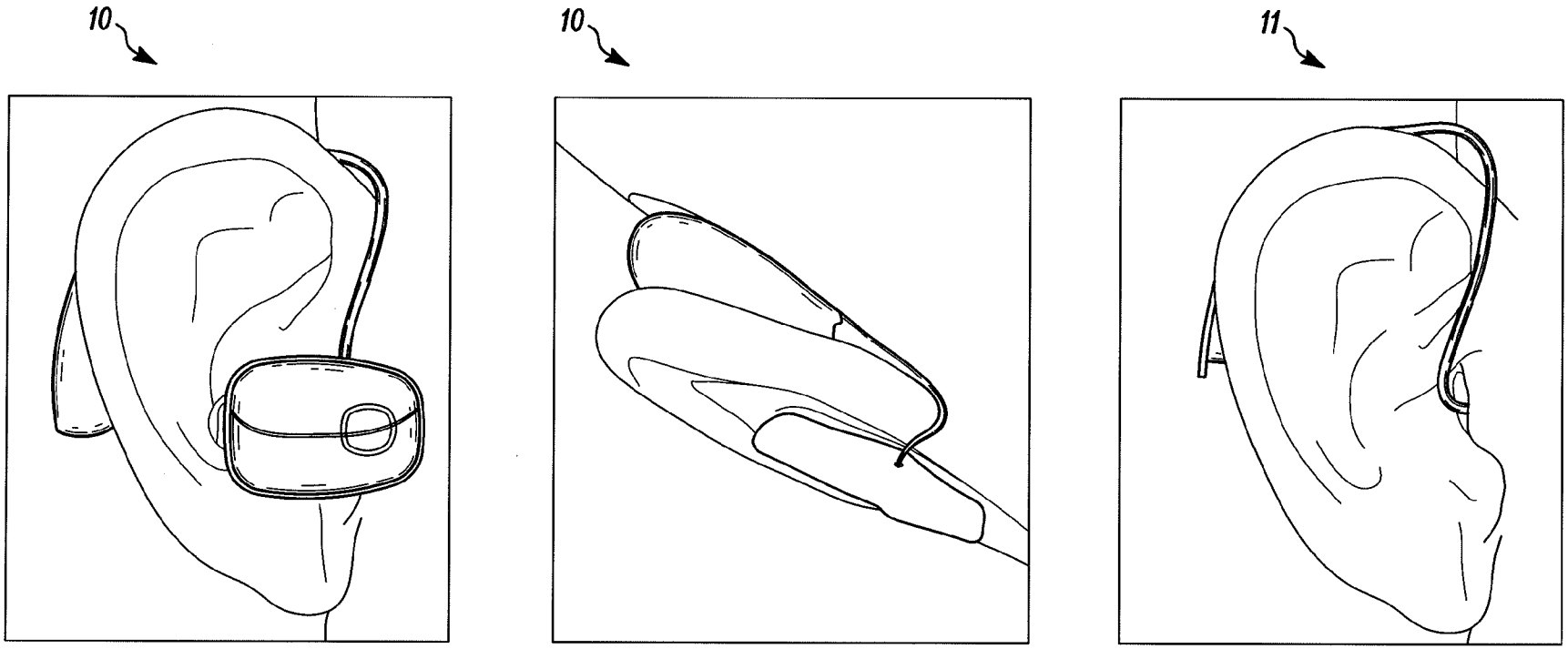

FIG. 1A illustrates two configurations (10 and 11) of the Normal Mode Of operation embodiment in accordance with the invention. An ear module 12A or 12D is coupled to a receiver module 12C which is coupled to electronics/wireless module 12B. The electronics module can be either in front of the ear (configuration 10) or behind the ear (configuration 11). In configuration 10 the electronics module 12B is connected via an "adjust length and lock" tube 15 with the microphone module 14A behind the ear. In the same configuration, a magnetic or mechanical "snap-on" battery module 14B is connected with the microphone module 14A. In configuration 11 the removable "snap on" battery module is connected directly to the electronics module 12B. FIGS. 1B-1C illustrates configurations 10 and 11 coupled to the ear of a user. User controls 17 can be carried on electronics module 12B.

Figure 2:
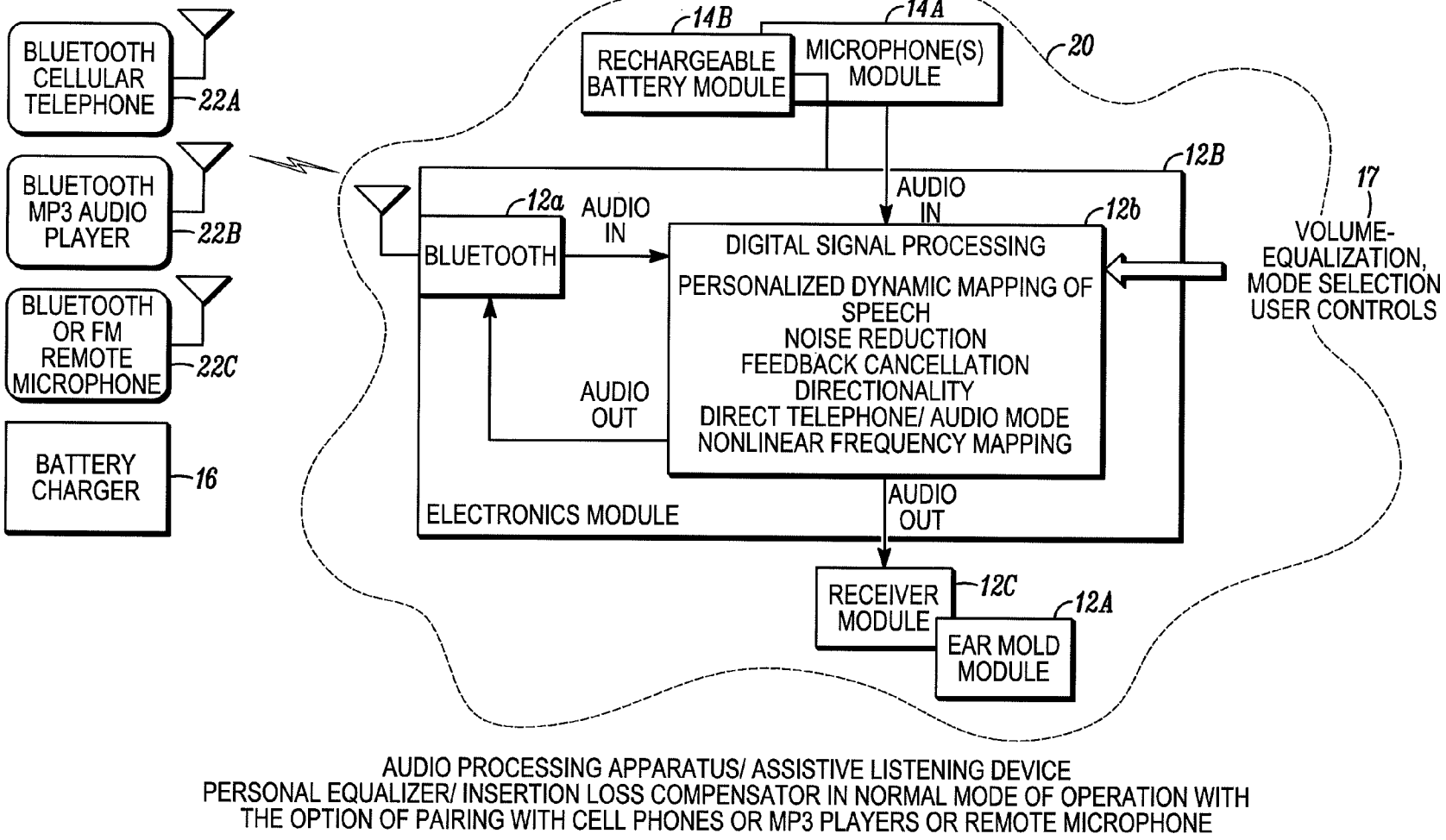
FIG. 2 is a block diagram of one embodiment—Normal Mode of operation of the invention.

FIG. 2 illustrates a block diagram of one implementation of the embodiment, in configurations 10 and 11 configured as a stand alone hearing device 20 which could be used with a wirelessly coupled cellular telephone 22A, a wirelessly coupled MP3 music player 22B, or a wirelessly coupled displaced microphone 22C.

Device 20 can also include a rechargeable battery module 14B, a user audio input microphone module 14A which can be carried by unit 12B, and a receiver module 12C which can also be carried by unit 12B, to provide audible output to the user's ear canal. Unit 12B can include a short range wireless transceiver 12*a*, for example, a BLUETOOTH brand transceiver, along with digital processing circuitry 12*b* which can carry out speech processing, noise reduction, feedback cancellation and other functions to improve a user's hearing experience relative to local audio input, via microphone 14A, or from any of the devices 22A, B or C.

The battery module 14B can be recharged by use of a manually operable battery charger 16, for example, a hand crankable generator.

Figure 3:
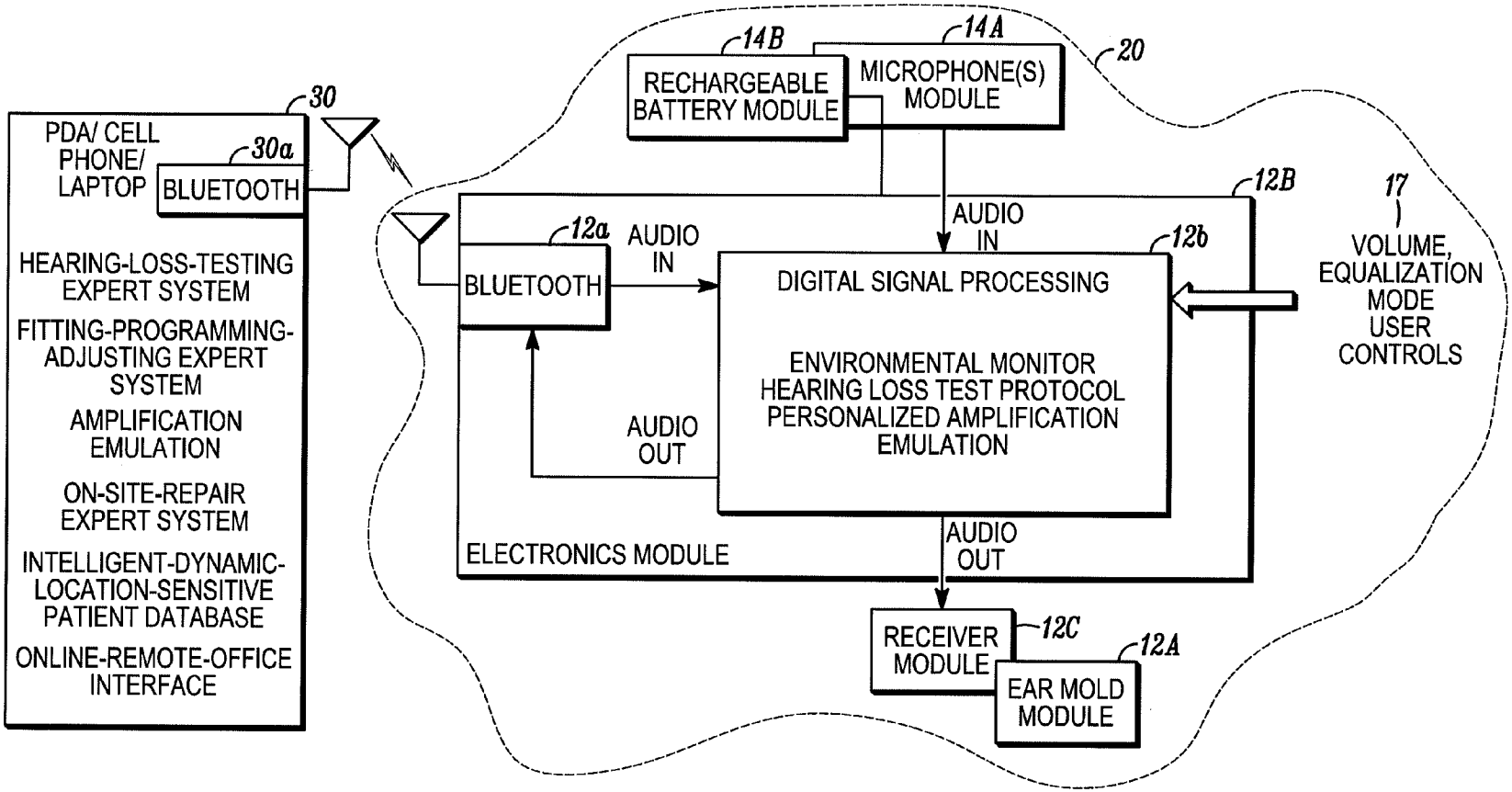
FIG. 3 is a block diagram of a second embodiment—Fine Tuning mode of operation of the invention.

FIG. 3 illustrates a block diagram of another implementation which includes an embodiment, such as the embodiment 10, wirelessly coupled to one of a personal digital assistant, a cellular-type telephone or a computer 30. In the implementation of FIG. 3, the unit 20 can be selectively adjusted, fine-tuned, hearing loss testing can be carried out, or amplification emulation can be implemented, via the unit 30. The unit 30 can also include a short range wireless transceiver 30*a,* compatible with the transceiver 12*a.*

Figure 4:
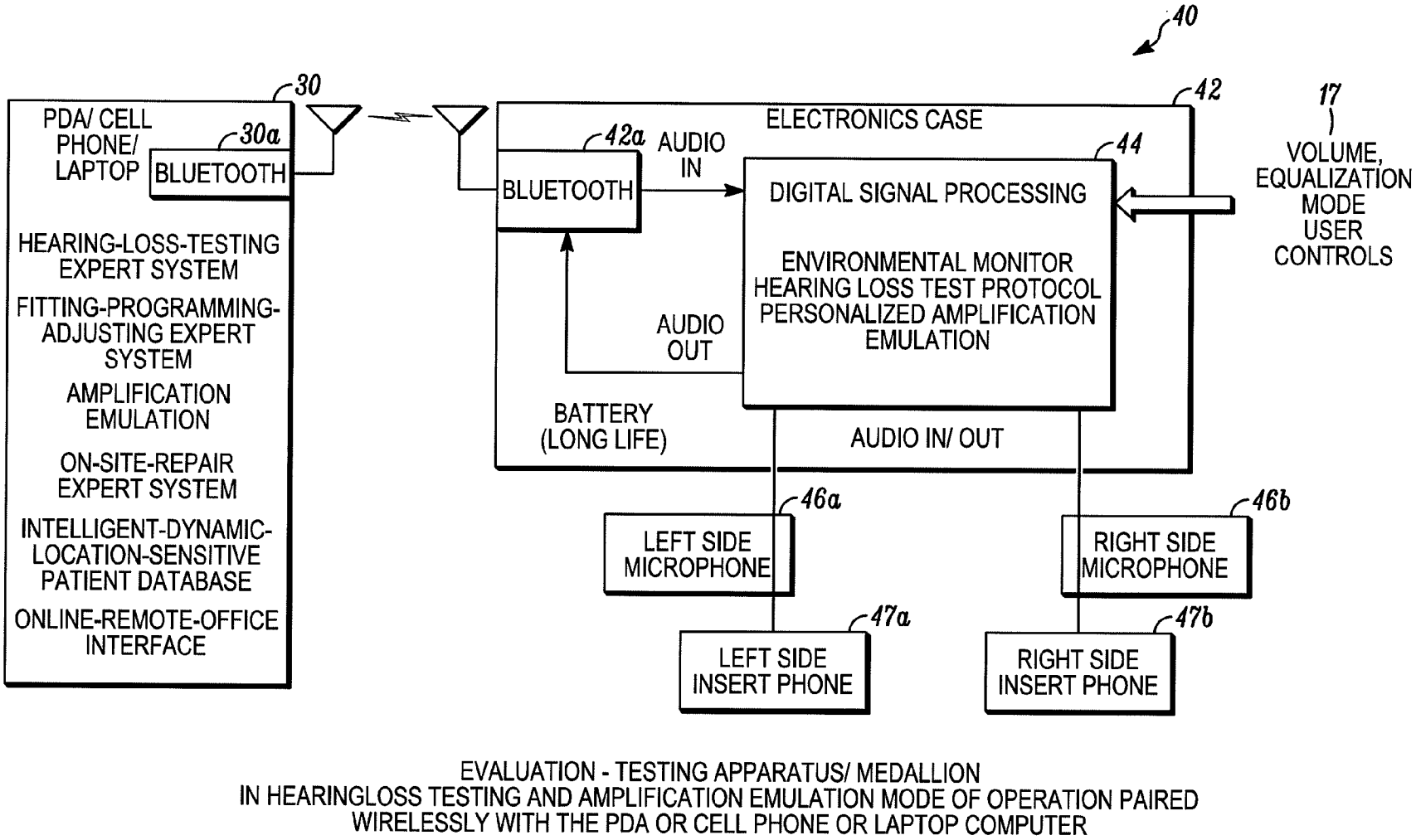
FIG. 4 is a block diagram of a third embodiment—Testing and Amplification Emulation Mode of the invention.

FIG. 4 illustrates a block diagram of a test/evaluation unit 40 usable to develop control parameters for use with the unit 10, 11 or 20. Unit 40 includes an electronics module 42 which can include one or more programmed processors as well as digital signal processing software 44. Left and right audio input/output microphones 46*a, b*, and telephone-type phone output audio devices 47*a, b* coupled to unit 40 receive audio from, or provide audio to the person being evaluated. A local short range wireless transceiver 42*a*, for example a BLUETOOTH brand device can be coupled to the electronics package and software 44 for communication to a wireless control unit 30.

The unit 30 can be implemented as a programmed PDA, cellular-type phone or a computer with a compatible transceiver 30*a*. Software implemented functions can include one or more of a Hearing-loss testing expert system, a fitting/adjusting programming expert system, an amplification emulation system, on-site repair system, as well as a local patient database, all without limitation.

Figure 5:
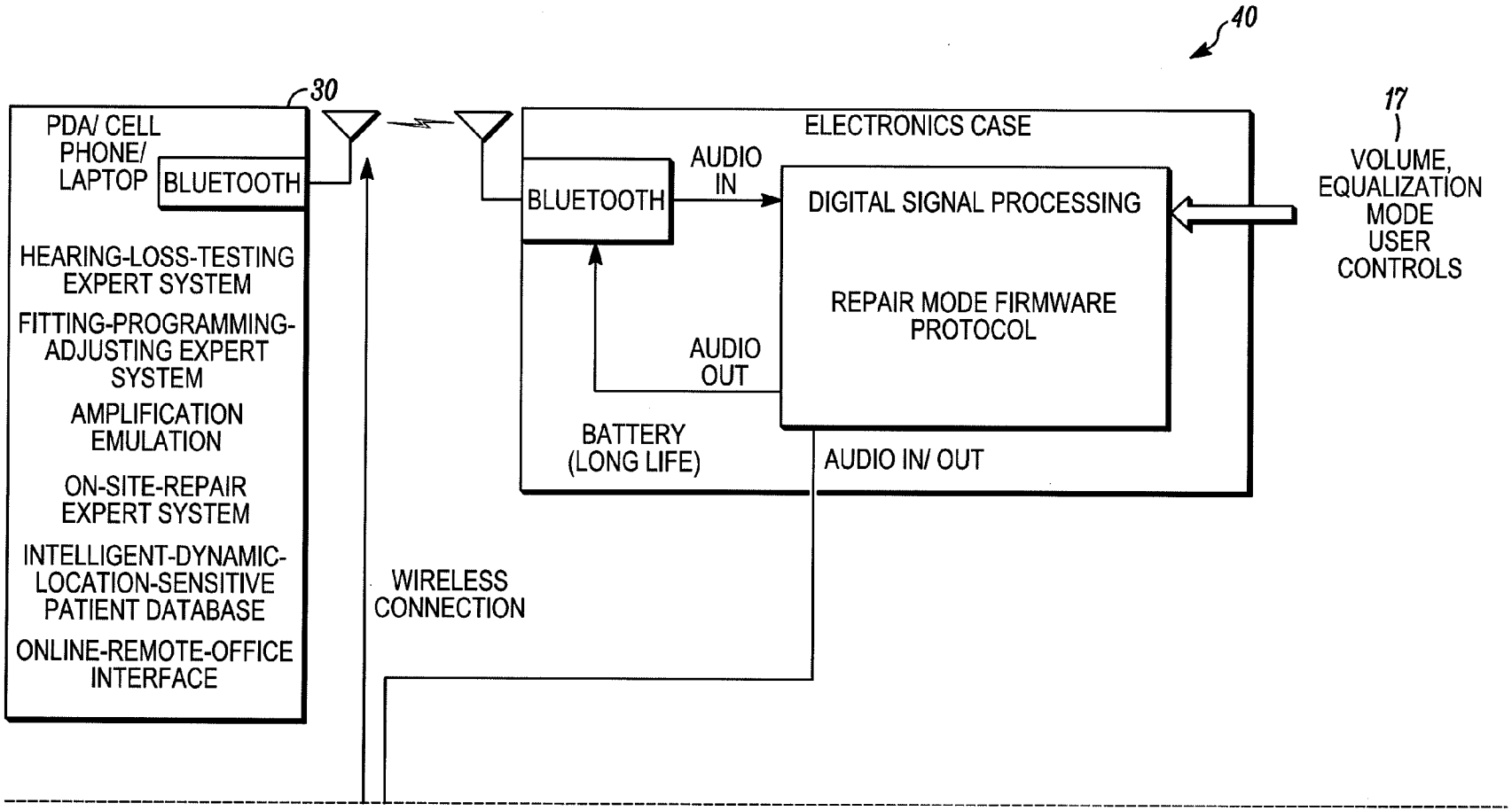
FIG. 5 is a block diagram of another embodiment—Repair Mode of the invention.
Figure 5:
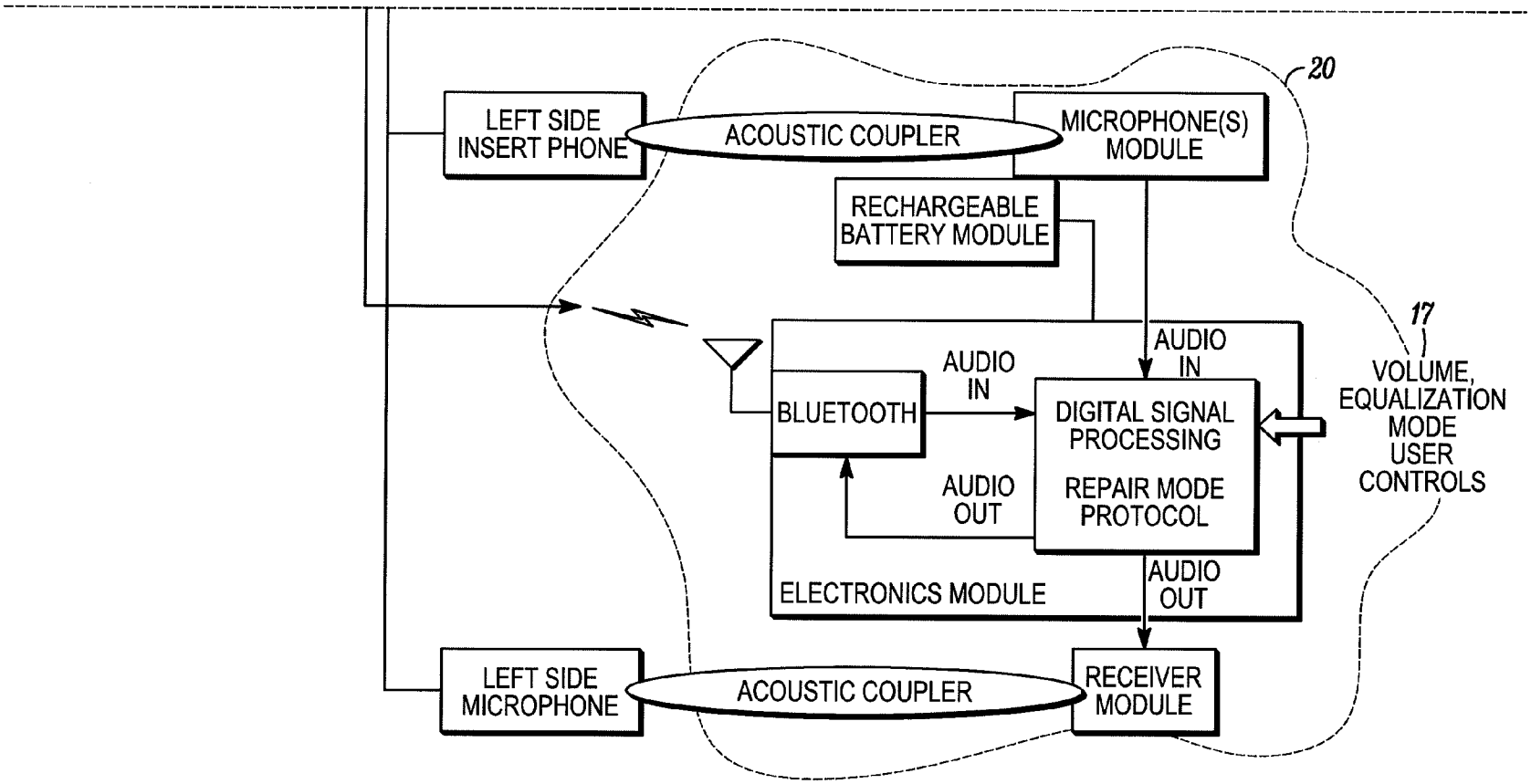

FIG. 5 illustrates a block diagram of the unit 10, 11, 20 combined with the test/evaluation unit 40 to implement a repair mode. It will be understood that other functions can be provided using the combination of FIG. 5, without limitation.

FIGS. 6A-6B illustrate an exemplary method of producing the ear mold 12A. A balloon is provided as in FIG. 6A. The balloon, with any internal inserts, is inserted in the ear canal of the user, as in FIG. 6B. The balloon is filled with a fast curing silicone as in FIG. 6B. Once the silicone has cured, the mold can be removed from the user's ear and attached to a corresponding electronics package as in FIG. 1A.

Figure 7A:
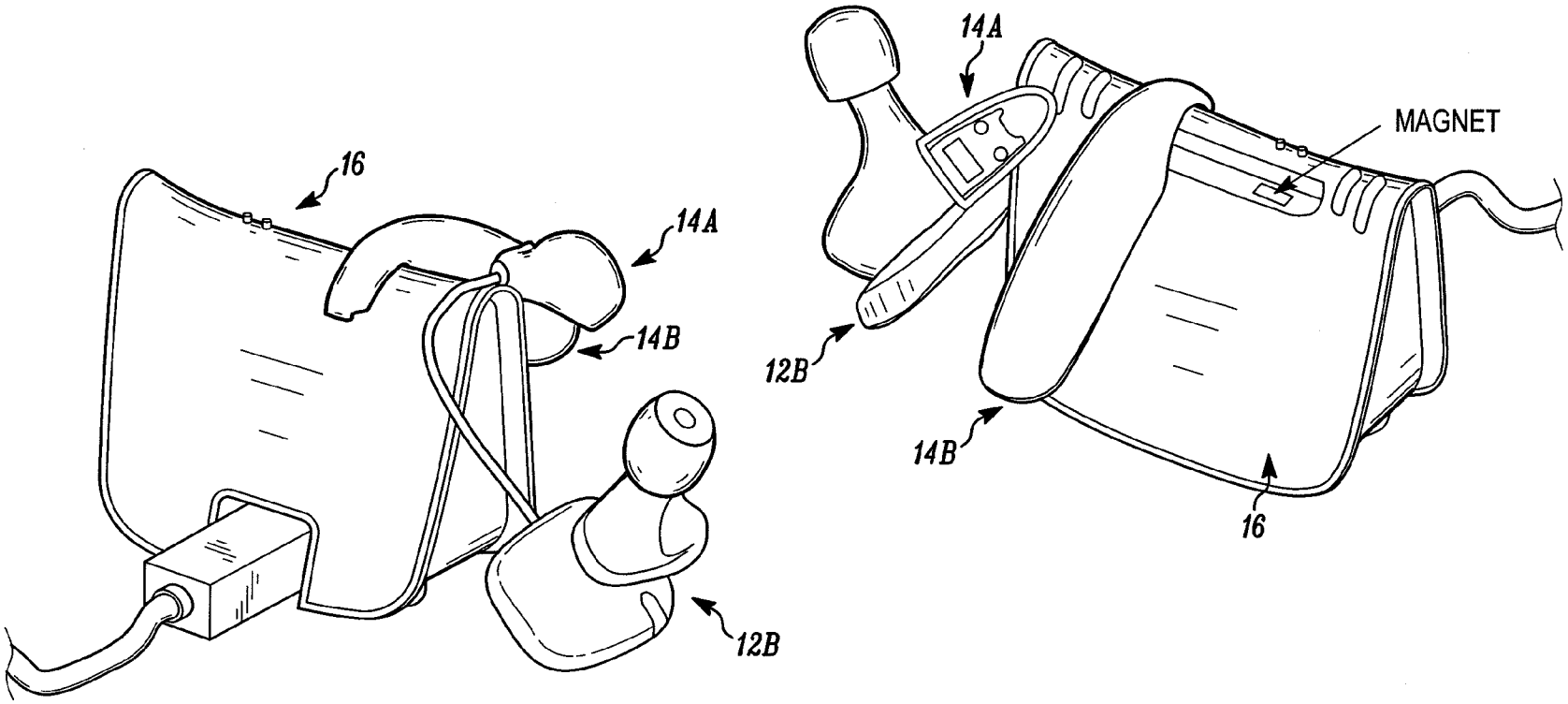
FIG. 7A illustrate aspects of a method for electrical charging of the invention.

FIG. 7A illustrates an exemplary method of coupling the rechargeable battery 14B in configuration 10 to the charger unit 16 using "snap on" magnetic coupling.

Figure 7B:
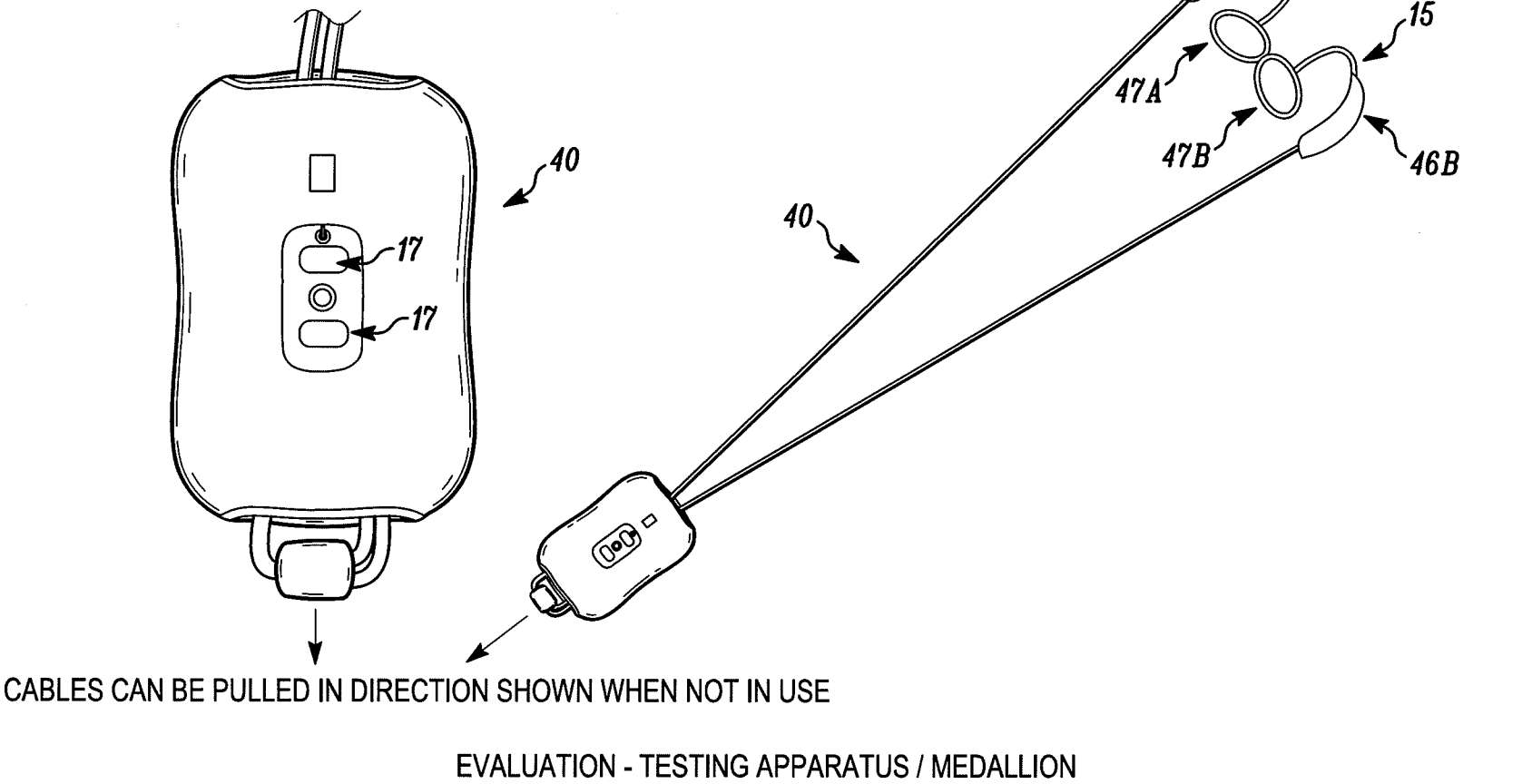
FIG. 7B illustrates a configuration of the invention as shown in its FIG. 4. Embodiment.

FIG. 7B illustrates an exemplary method of adjusting the cable length of the Evaluation-Testing apparatus/Medallion, unit 40.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A modular audio processing apparatus comprising:

a plurality of separate, releasably connectable, modules including a shaped, ear module;

a receiver module;

a microphone module;

a rechargeable battery module; and an electronics module mechanically connected to the receiver and the microphone module where the electronics module includes digital signal processing circuits to process incoming audio signals from the microphone module and also from a relatively short range wireless transceiver where the short range wireless transceiver can receive signals from a displaced compatible transceiver; and which includes an adjust and lock tube interconnecting the microphone module with at least one other module with an adjustable length interconnection.

2. An apparatus as in claim 1 which includes a battery charger that supports solar or user generated energy sources.

3. An apparatus as in claim 1 which includes a wireless remote selected from a class which includes at least one of a telephone-type device, an audio-type player, a displaced microphone, a computer or a personal digital assistant, said wireless remote in communication with the electronics module via the short range wireless transceiver and wherein a local user or local or displaced assistant can use the remote to carry out a fitting process, a fine tuning process or a hearing testing process, said hearing testing process including an environmental acoustic monitoring process to assist accuracy of hearing loss test protocol results.

4. An apparatus as in claim 1 where the electronics module includes circuitry for at least one of personalized dynamic mapping of speech, noise reduction, feedback cancellation, directionality, directly telephone/audio mode, non-linear frequency mapping.

5. An apparatus as in claim 1 where the electronics module includes circuitry for at least compensating for the hearing insertion loss due to the coupling of the device to the ear canal.

6. An apparatus as in claim 1 which includes at least one of a telecoil or additional microphone in the electronics module.

7. An apparatus as in claim 1 which includes a plurality of different sized ear molds, each of which can be mechanically attached to a respective ear module.

8. An apparatus as in claim 1 where the ear module carries an inflatable balloon which can be filed with silicone which when cured will correspond to a user's ear canal.

9. An apparatus as in claim 1 where the microphone module and battery module can be connected to one another by a magnetic connection.

10. An apparatus as in claim 3 where the local user or local or displaced assistant can communicate wirelessly with the electronics module via wireless transceivers.

11. A modular audio processing apparatus comprising:

a plurality of separate, releasably connectable, modules including a shaped, ear module;

a receiver module;

a microphone module;

a rechargeable battery module; and an electronics module mechanically connected to the receiver module where the electronics module includes digital signal processing circuits to process incoming audio signals from the microphone module and also from a relatively short range wireless transceiver where the short range wireless transceiver can receive signals from a displaced compatible transceiver;

and which includes an adjust and lock tube interconnecting one module with a second module with an adjustable length interconnection.

12. An apparatus as in claim 11 where the battery module is separate from the other modules and is releasibly coupled to one of the modules, wherein the battery module can be removed, recharged and recoupled to the one module.

13. An apparatus as in claim 11 where the electronics module includes digital signal processing circuitry which can carry out personalized dynamic mapping of speech, noise reduction, or feedback cancellation relative to local audio input via the microphone module or from a separate, wirelessly coupled, source.

14. An apparatus as in claim 12 where the electronics module includes digital signal processing circuitry which can carry out personalized dynamic mapping of speech, noise reduction, or feedback cancellation relative to local audio input via the microphone module or from a separate, wirelessly coupled, source and where the battery module is magnetically connected to another module.

15. An apparatus as in claim 1 wherein the battery module is releasibly connected to the apparatus.

16. An apparatus as in claim 1 wherein the apparatus can automatically switch between signals from the microphone module, or, from the short range wireless transceiver.

* * * * *